United States Patent [19]

Stark

[11] 4,233,783

[45] Nov. 18, 1980

[54] DEVICE PARTICULARLY USEFUL FOR CUTTING OR GRINDING ROUND GIRDLES OF GEMS

[75] Inventor: Hanoch Stark, 60 Harishonim St., Ramat Hasharon, Israel

[73] Assignee: Hanoch Stark, Ramat Hasharon, Israel

[21] Appl. No.: 6,999

[22] Filed: Jan. 26, 1979

[51] Int. Cl.[3] ..... B24B 9/16

[52] U.S. Cl. ..... 51/73 R; 125/30 R

[58] Field of Search ..... 51/73 R, 289 S, 241 S; 125/30 R

[56] References Cited

U.S. PATENT DOCUMENTS

| | | | |
|---|---|---|---|
| 2,982,057 | 5/1961 | Stanhope | 51/73 R |
| 3,020,680 | 2/1962 | Soderman | 51/73 R |

FOREIGN PATENT DOCUMENTS

| | | | |
|---|---|---|---|
| 247788 | 3/1947 | Switzerland | 51/73 R |

*Primary Examiner*—Harold D. Whitehead
*Attorney, Agent, or Firm*—Benjamin J. Barish

[57] ABSTRACT

A cutting device is described particularly useful for cutting or grinding the round girdle surfaces of round-cut gems, the cutting device comprising a plurality of cutting heads each formed with a grinding surface on one face defined by a cavity circular in transverse section and having a larger diameter than that of the round surface to be cut. The device further includes a drive for rotating the heads around the longitudinal axis of its respective cavity, and nozzles for supplying liquid to the grinding surfaces of the cavities.

6 Claims, 4 Drawing Figures

DEVICE PARTICULARLY USEFUL FOR CUTTING OR GRINDING ROUND GIRDLES OF GEMS

BACKGROUND OF THE INVENTION

The present invention relates to a cutting or grinding device for cutting outer round or circular surfaces. The invention is particularly useful for cutting the round girdles of round-cut gems, and is therefore described below with respect to such application.

The cutting of the girdle of a round-cut gem is usually a time-consuming manual operation. Many devices have been developed for this job, but the known devices, as a rule, are not entirely satisfactory, particularly for use with the lesser expensive gems, where low-cost, volume production is exceptionally important.

An object of the present invention is to provide a low-cost cutting device for cutting or grinding round surfaces, and particularly for cutting the round girdles of round-cut gems.

SUMMARY OF THE INVENTION

According to a broad aspect of the present invention, there is provided a device particularly useful for cutting or grinding the round girdle surface of round-cut gems comprising a base and a plurality of cutting heads rotatably mounted on the base about spaced horizontal axes arranged in a straight line. Each of the cutting heads is formed on one face with a cavity having a grinding surface circular in transverse section and having a large diameter than that of the round surface to be cut. The outer end of the cavity is curved, and its grinding surface has abrasive particles fixed to it. In addition, the device further includes a supprt extending across the base and spaced from the open end of the cutting heads, which support includes means for supporting a gem-holder in alignment with cavity of each cutting head. The device further includes a nozzle for each cutting head for supplying a liquid medium to the grinding surface of its cavity, a receptacle underlying the cutting heads for receiving the liquid medium run-off from the heads, and a pump for pumping the liquid back to the nozzles.

In the preferred embodiment of the invention described herein, the cavity is of increasing diameter from its inner end to its outer end, the rate of increase in diameter of the cavity being greater at its inner end than at its outer end.

Also in the described preferred embodiment, the support includes a bar extending across the base in front of the cutting heads, the holder supporting means comprising cut-outs in the bar, one for each gem-holder.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
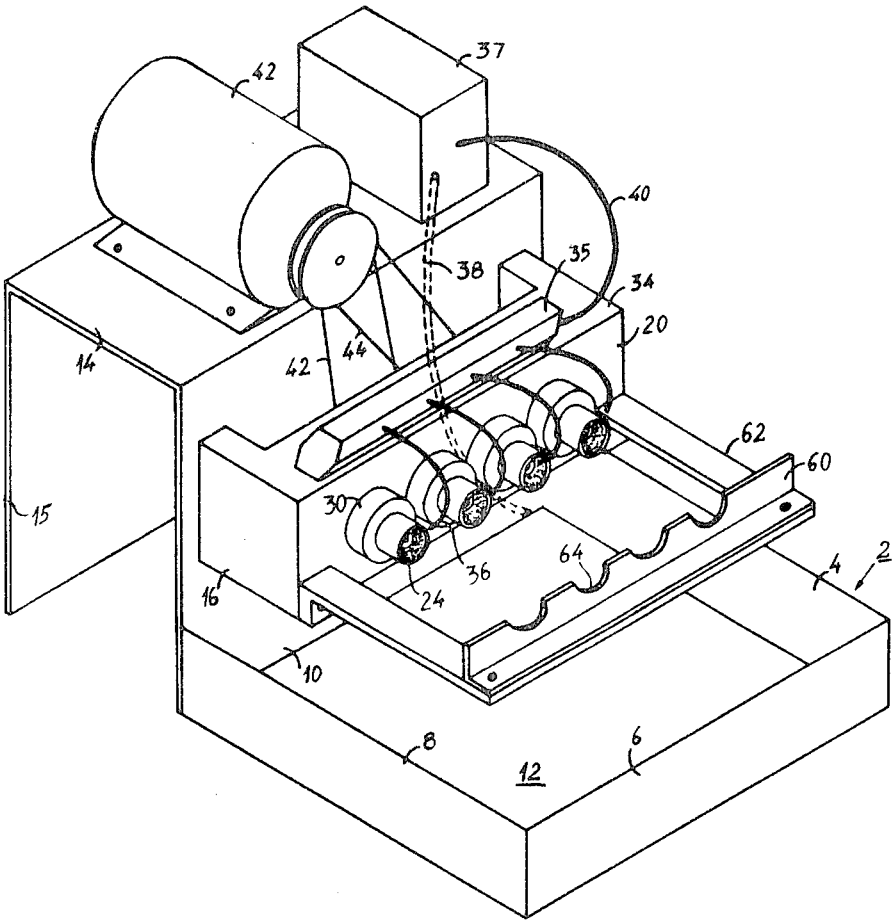
FIG. 1 is a three-dimensional view illustrating one form of cutting or grinding device constructed in accordance with the invention.

The device illustrated in the drawings comprises a base, generally designated 2, formed at its front end with four vertical walls 4, 6, 8, 10, defining between them a liquid receptable 12. The rear vertical wall 10 is extended to provide a horizontal platform 14 and a rear vertical leg 15.

Figure 2:
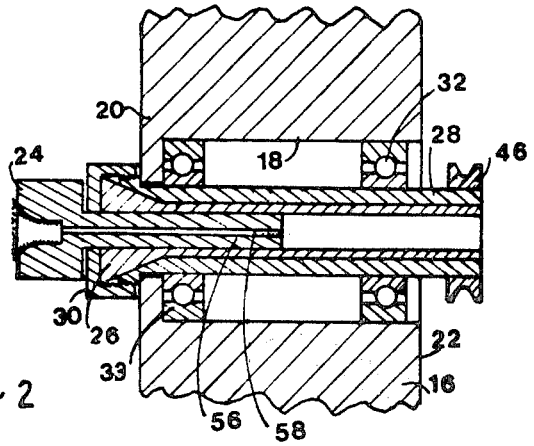
FIG. 2 is a sectional view illustrating one mounting and cutting head in the device of FIG. 1.

Mounted to vertical wall 10 is a block 16 formed with four cylindrical bores 18 (FIG. 2) extending therethrough from its front face 20 through its rear face 22. A cutting head 24 is rotatably supported in each bore 18 by means of a split, coned collect 26 fixed within a sleeve 28 by a threaded cap 30, the assembly being rotatably mounted within the bore 18 by roller bearings 32, 33. The structure of each of the cutting heads 22 is the same (although their diameters may vary), and is described below particularly with respect to FIGS. 3 and 4.

The upperwall 34 of block 16 supports a conduit or header 35 for supplying liquid to a plurality of nozzles 36, one for each of the cutting heads 24. Nozzles 36 are in the form of rigid tubes having their inlet ends connected to headers 35, and their outlet ends curved to overlie the front of the respective cutting head. Header 35 is supplied with the liquid by means of a pump 37 connected to receptacle 12 via a feed tube 38 and connected to the header 35 via a delivery tube 40.

Pump 37 is supported on the horizontal platform 14. Also supported on this platform is a drive motor 42 which rotates all the cutting heads 24 by means of two pulley belts 42, 44, each driving two of the heads 24 by means of pulleys 46 (FIG. 2) fixed to their respective mounting sleeves 28.

Figure 3:
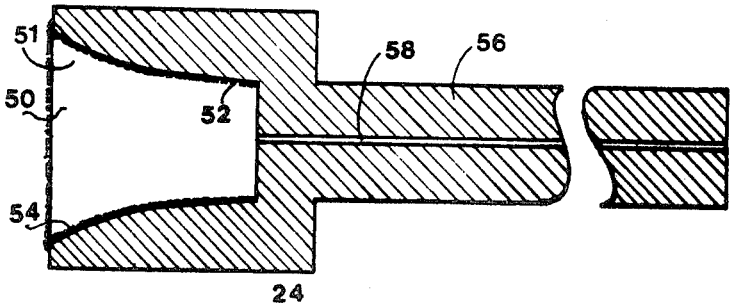
FIG. 3 is an enlarged transverse sectional view of one of the cutting heads in the device of FIGS. 1 and 2.
Figure 4:
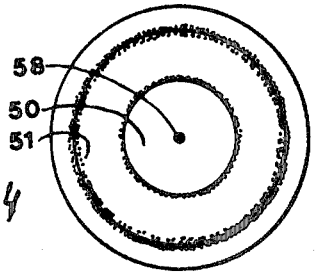
FIG. 4 is an end view of the cutting head of FIG. 3.

As shown in FIGS. 3 and 4, each of the cutting heads 24 is formed with a recess or cavity 50 which serves as the cutting or grinding surface of the head. The surface of cavity 50 in each head has particles of abrasive material, e.g. diamond dust 51, bonded thereto. Each cavity is of increasing diameter from its inner end 52 to its outer end 54. Preferably, the rate of increase in the diameter of the cavity is greater at the outer end than at the inner end. For example, the depth of the cavity could be about 13 mm, the inner 4 mm portion of the cavity having a linearly increasing diameter, and the outer 9 mm portion of the cavity having a diameter increasing along a radius of curvature of about 10 mm. The diameter of the cavity could vary according to the diameter of the round girdles to be cut.

The end of each cutting head 24 opposite to its cavity 50 is formed with a shank 56 of reduced outer diameter. The head is secured to its sleeve 28 by means of its shank 56. An axial bore 58 extends through shank 56 to cavity 50.

As seen in FIG. 1, all the cutting heads 24 are supported in a straight line over run-off receptacle 12. Overlying this receptacle is a supporting bar 60 secured to block 16 by a three-sided bracket 62. Bar 60 is provided with a line of semi-circular cut-outs 64 each for supporting a holder for a round-cut gem in alignment with one of the cutting heads 24, with the round girdle of the gem disposed within cavity 50 of the respective head and engageable with the abrasive particles 51 on its surface.

In use, motor 42 rotates all the cutting heads 24 via belts 42, 44; and pump 37 pumps a liquid, such as water, to header 35 from where the liquid is distributed via nozzles 36 to the cavities 50 of the heads 24. The gems are supported by holders (not shown) resting on the circular-cuts 64 of supporting bar 60. As the cutting heads are rotated, each holder is manipulated to cause the round girdle of its gem to engage the grinding surface in the cavity 50 of the respective head. The run-off of liquid from nozzles 36 is received within receptacle 12 and is returned by pump 37 to the header 34 via feed tube 38 and delivery tube 40. Some of the liquid also passes through bores 58 (FIGS. 3 and 4) in the respective heads 24 to return back to the receptacle 12 through the rear side 22 of the block 16.

It will be appreciated that the diameters of the cavities 50 may vary in accordance with the diameters of the girdles to be cut, but should be significantly larger than the girdles to permit manipulation of the gem within the cavity. The multi-head device illustrated could have heads of different diameters, or of the same diameter.

While the invention has been described with respect to one particular embodiment, it will be appreciated that many variations, modifications and other applications of the invention may be made.

What is claimed is:

1. A device particularly useful for cutting or grinding the round girdle surfaces of round-cut gems, comprising: a base; a plurality of cutting heads rotatably mounted on said base about spaced horizontal axes arranged in a straight line; each of said cutting heads being formed on face with a cavity having a grinding surface circular in transverse section and having a larger diameter than that of the round surface to be cut; the outer end of the cavity being curved and its grinding surface having abrasive particles fixed thereto; a support extending across said base and spaced forwardly of said cutting heads; said support including holder-supporting means for supporting a gem-holder in alignment with the cavity of each cutting head; a nozzle for each cutting head for supplying a liquid medium to the grinding surface of its cavity; a receptacle underlying all the cutting heads for receiving the liquid medium run-off from the heads; a pump for pumping said liquid back to the nozzles and a drive for rotating each head around the longitudinal axis of its cavity.

2. A device according to claim 1, wherein said cavity is of increasing diameter from its inner end to its outer end.

3. A device according to claim 2, wherein the cavity increases in diameter at a greater rate at its outer end than at its inner end.

4. A device according to claim 1, wherein each cutting head is formed with a bore extending axially from its cavity to the opposite end thereof, said opposite end of each head communicating with said receptacle.

5. A device according to claim 1, further including a header connected to the inlet ends of all said nozzles, and a delivery tube connected between the header and the pump.

6. A device according to claim 1, wherein said support includes a bar extending across the base forwardly of the cutting heads, said holder supporting means comprising a cut-out in said bar for each holder.

* * * * *

UNITED STATES PATENT OFFICE

CERTIFICATE OF CORRECTION

Patent No. 4,233,783 Dated November 18, 1980

Inventor(s) Hanoch Stark

It is certified that error appears in the above-identified patent and that said Letters Patent are hereby corrected as shown below:

The name of the Assignee should be: --Hargem Ltd.,

Ramat Gan, Israel--

Signed and Sealed this

*Fourteenth* Day of *July 1981*

[SEAL]

*Attest:*

GERALD J. MOSSINGHOFF

*Attesting Officer*

*Commissioner of Patents and Trademarks*